US008104581B2

(12) United States Patent
Gendermann

(10) Patent No.: US 8,104,581 B2
(45) Date of Patent: Jan. 31, 2012

(54) OIL MODULE FOR AN INTERNAL COMBUSTION ENGINE

(75) Inventor: Rainer Gendermann, Havixbeck (DE)

(73) Assignee: Hengst GmbH & Co. KG, Muenster (DE)

( * ) Notice: Subject to any disclaimer, the term of this patent is extended or adjusted under 35 U.S.C. 154(b) by 1364 days.

(21) Appl. No.: 10/573,119

(22) PCT Filed: Sep. 21, 2004

(86) PCT No.: PCT/EP2004/010572

§ 371 (c)(1),
(2), (4) Date: May 11, 2006

(87) PCT Pub. No.: WO2005/031128

PCT Pub. Date: Apr. 7, 2005

(65) Prior Publication Data

US 2007/0068737 A1 Mar. 29, 2007

(30) Foreign Application Priority Data

Sep. 23, 2003 (DE) ..... 203 14 687 U

(51) Int. Cl.
*F01M 5/00* (2006.01)

(52) U.S. Cl. ..... 184/6.22; 123/196 AB; 165/51

(58) Field of Classification Search ..... 184/6.22; 123/196 AB; 165/51
See application file for complete search history.

(56) References Cited

U.S. PATENT DOCUMENTS

| | | | | |
|---|---|---|---|---|
| 3,353,590 | A * | 11/1967 | Holman | 165/297 |
| 3,830,289 | A * | 8/1974 | Olson | 165/51 |
| 4,426,965 | A * | 1/1984 | Patel | 123/196 AB |
| 4,793,302 | A * | 12/1988 | Osborne et al. | 123/196 AB |
| 5,351,664 | A * | 10/1994 | Rotter et al. | 123/196 AB |
| 5,544,699 | A | 8/1996 | Robers et al. | |
| 5,575,329 | A | 11/1996 | So et al. | |
| 5,950,715 | A * | 9/1999 | Jonsson et al. | 165/103 |
| 6,461,126 | B1 * | 10/2002 | Pierobon | 417/569 |
| 7,353,794 | B2 * | 4/2008 | Gruner et al. | 123/196 AB |
| 7,735,520 | B2 * | 6/2010 | Peric | 137/855 |
| 2002/0129926 | A1 * | 9/2002 | Yamaguchi | 165/41 |
| 2003/0185695 | A1 * | 10/2003 | Sieberg | 417/569 |

FOREIGN PATENT DOCUMENTS

| | | |
|---|---|---|
| DE | 196 54 365 A1 | 6/1998 |
| DE | 197 37 247 A1 | 3/1999 |
| FR | 2 832 791 A | 5/2003 |

* cited by examiner

*Primary Examiner* — Robert Siconolfi
*Assistant Examiner* — James Hsiao
(74) *Attorney, Agent, or Firm* — Greer, Burns & Crain, Ltd.

(57) ABSTRACT

An oil module for an internal combustion engine, comprising a carrier element that can be flanged onto an engine block of the internal combustion engine and carries at least one oil filter and an oil cooler. The oil module is provided with channels for guiding oil and water, one of the channels being an oil cooler bypass channel connecting an oil inlet of the oil cooler to an oil outlet of the oil cooler. At least a main part of the oil cooler bypass channel extends through an oil cooler base plate occluding the oil cooler on the carrier element side, or through an intermediate plate arranged between the oil cooler and the carrier element in a sealing manner.

18 Claims, 5 Drawing Sheets

OIL MODULE FOR AN INTERNAL COMBUSTION ENGINE

BACKGROUND OF THE INVENTION

This invention relates to an oil module for an internal combustion engine, comprising a carrier element that can be flanged onto an engine block of the internal combustion engine and carries at least one oil filter and an oil cooler. Said oil module is provided with channels for guiding oil and water, one of said channels being an oil cooler bypass channel connecting an oil inlet of the oil cooler to an oil outlet of the oil cooler.

An oil module of the above mentioned type is known from EP 0 816 645 B1. For this known oil module, it is provided that a bypass channel extending exclusively within the carrier element is integrated in said carrier element for a throttled bypass to the oil guidance through the oil cooler. This bypass ensures that, in case of cold and thus viscous oil, a relatively large part of the oil will flow—bypassing the oil cooler—to the lubricating points of the internal combustion engine to ensure adequate lubrication even when the lubricating oil is still cold. With an increasing temperature of the lubricating oil, an increasingly larger portion of the oil flows through the oil cooler, thus reducing the temperature of the oil to prevent thermal damage of the oil of the internal combustion engine due to excessively high oil temperatures.

Particularly in the automotive industry, there is a general endeavor to be able to produce different designs of an internal combustion engine in a modular manner. The maximum possible identical components are thus to be used for different designs of the internal combustion engine. The internal combustion engines will then differ e.g. by one design having a turbocharger and another design having no turbocharger. In their different versions, the internal combustion engines usually differ in performance with the consequence that there will be different requirements regarding the oil module and the oil cooler provided therein depending on the design of the internal combustion engine. These different requirements can be met, for example, by the bypass being differently designed, especially with a different passage cross section—depending on the design of the internal combustion engine to which the oil module is connected. If the passage cross section of the bypass channel is to be changed for the carrier element according to the above cited state of the art, it will be necessary to either change the injection mold for the die-cast manufactured carrier element or to subsequently mechanically work on every manufactured carrier element. Both ways are technically complicated and result in high costs which have a negative effect on profitability.

SUMMARY OF THE INVENTION

Accordingly, this invention has the objective of creating an oil module of the initially mentioned type which avoids the presented disadvantages and in which an adjustment to different requirements—especially a change of the passage cross section of the bypass channel—will be possible with lower expenditures and thus lower costs.

This problem is solved according to the invention with an oil module of the initially mentioned type, characterized in that at least the main part of the oil cooler bypass channel extends through an oil cooler base plate occluding the oil cooler on the carrier element side, or through an intermediate plate arranged between the oil cooler and the carrier element in a sealing manner.

With the oil module according to the application, at least the main part of the oil cooler bypass channel is provided—essential for the invention—in the oil cooler base plate or in an intermediate plate, not however in the die-cast manufactured carrier element. The oil cooler base plate as well as the intermediate plate are, compared with a die-cast element, very simple components which can be inexpensively manufactured and in which smaller form changes can also be made with little expenditure and thus at low cost. Accordingly, for different designs of the associated internal combustion engine, the same carrier element can always be employed; any possibly required adjustment will then be made by a simple change or, respectively, selection of the suitable oil cooler base plate or intermediate plate. Complicated and expensive changes on the injection mold for the carrier element will thus be entirely avoided. When the intermediate plate is used, even the oil cooler can remain unchanged which spares the manufacture of different oil cooler designs. Merely different intermediate plates need then be manufactured and built in, depending on the design of the associated internal combustion engine.

A further development of the invention provides that the oil cooler bypass channel is formed in the oil cooler base plate or in the intermediate plate by at least one slit extending over the entire thickness of the oil cooler base plate or the intermediate plate; said slit being sealed towards the outside environment on the oil cooler side by the remaining oil cooler and on the carrier element side by the carrier element. The design of the oil cooler bypass channel as a slit extending through the oil cooler base plate or the intermediate plate over their entire thickness renders its manufacture particularly simple since such a slit can be manufactured with little expenditure and can also be changed in its contour with little expenditure, as needed.

As an alternative to the above described embodiment, it is proposed that the oil cooler bypass channel in the oil cooler base plate or in the intermediate plate is formed by at least one pressed-in bead or milled groove in the oil cooler base plate or the intermediate plate on the carrier element side or the oil cooler side; said bead or groove being sealed towards the outside environment by the carrier element on the carrier element side or by the remaining oil cooler on the oil cooler side. Here, the oil cooler bypass channel is already occluded on its one side which simplifies the sealing.

Furthermore, it is preferably provided that the oil cooler bypass channel extends over its entire length in the oil cooler base plate or in the intermediate plate. This design of the oil module has the advantage that the carrier element can receive a simplified form since it is not involved in the guiding of the oil cooler bypass channel.

An alternative development of the oil module provides that one part of the oil cooler bypass channel lying in the oil cooler base plate or in the intermediate plate forms a middle section of the oil cooler bypass channel and that two shorter end sections of the oil cooler bypass channel each extend through the carrier element. This embodiment has the advantage that the oil cooler base plate or intermediate plate has a higher stability and dimensional stability because the part of the oil cooler bypass channel lying in the oil cooler base plate or intermediate plate does not take up the entire length between an oil inlet and an oil outlet in the form of openings in the oil cooler base plate or intermediate plate. Much rather, stabilizing material bridges will respectively remain—in the vicinity of the openings for the oil inlet and the oil outlet in the oil cooler base plate or intermediate plate—between the openings on the one hand and the middle section of the oil cooler bypass channel on the other hand.

Another alternative development of the oil module proposes that one part of the oil cooler bypass channel lying in the intermediate plate forms two end sections of the oil cooler bypass channel and that a shorter middle section of the oil cooler bypass channel extends through the carrier element. This embodiment has the advantage that—in the area of the middle section of the oil cooler bypass channel—the oil cooler base plate or intermediate plate can comprise a material bridge which, analogously to the above described embodiment, provides for an increase in the stability and dimensional stability of the oil cooler base plate or intermediate plate.

To achieve the desired function of the oil cooler bypass channel, it is essential to maintain a defined flow resistance of the oil cooler bypass channel. To meet this requirement, another development of the oil module provides that the oil cooler bypass channel has a cross section comprising a throttling effect. A change of the throttling effect can here be achieved overall by a change of the cross section of the oil cooler bypass channel.

Alternatively thereto, the oil cooler bypass channel can have, in its course, at least one cross-sectional narrowing having a throttling effect. In this embodiment, the flow resistance of the oil cooler bypass channel can be determined by a suitable design or change of the cross-sectional narrowing.

A further development provides in this respect that the cross-sectional narrowing is formed by at least one nose protruding into the oil cooler bypass channel. Such a design can be simply manufactured and also simply modified so that simple and economic manufacturing will be ensured.

According to another alternative, it is provided that the cross-sectional narrowing is formed by at least one overlapping area between one end of the oil cooler bypass channel and a channel area on the carrier element side being connected with the oil inlet or oil outlet of the oil cooler. A change in the flow resistance of the oil cooler bypass channel can here be achieved by the overlapping area being changed in its size which can be realized, for example, by changing the length of overlapping between the oil cooler bypass channel on the one hand and the channel area in the carrier element on the other hand.

For all above described embodiments of the oil module, it is preferably provided that the oil cooler base plate or the intermediate plate is a stamping of metal, particularly light metal, such as aluminum. A stamping is a component which can be especially economically manufactured, thus contributing to the low manufacturing costs of the oil module. The use of metal—particularly light metal—ensures good durability on the one hand and, on the other hand, low weight and simultaneously good thermal conductivity. Aluminum is here particularly suited.

It is furthermore provided according to the invention that the oil cooler base plate or the intermediate plate is manufactured by means of a stamping tool with an exchangeable tool insert in the area of the oil cooler bypass channel. In this embodiment, a uniform basic stamping tool can be used for the manufacture of the oil cooler base plate or intermediate plate where merely a tool insert needs to be exchanged for a change of the plate.

In those cases where the desired temperature-dependent distribution of the oil flow to the oil cooler and the oil cooler bypass channel cannot be achieved by the oil cooler bypass channel alone, the invention proposes that a valve is arranged in the course of the oil cooler bypass channel which—depending on a pressure difference between the oil inlet and the oil outlet of the oil cooler—releases a modifiable passage cross section, with the passage cross section being smaller at a lower differential pressure and the passage cross section being larger at a higher differential pressure. A lower differential pressure occurs especially when the oil is warm so that there will be a higher cooling requirement for the oil and accordingly a larger portion of the oil is to be guided through the oil cooler. Conversely, with cold oil, a higher differential pressure will occur which results in a larger portion of the oil being guided through the oil cooler bypass channel.

To be able to also manufacture the oil module in an embodiment with a valve as economically as possible, it is furthermore provided that the valve is formed by a leaf spring which is arranged in the oil cooler bypass channel pointing into the direction of flow of the oil; with the leaf spring—in a non-loaded or lightly loaded differential pressure condition—obliquely extending through the oil cooler bypass channel and—in a more strongly loaded differential pressure condition—being automatically adjustable from its obliquely extending position through the oil cooler bypass channel into a position increasingly extending in parallel direction to the oil cooler bypass channel, releasing an increasing cross section.

Finally, for the oil module with valve according to the invention, it can be additionally provided that the leaf spring consists of a bimetal strip or comprises a bimetal strip, by which the leaf spring in its position in the oil cooler bypass channel is automatically adjustable depending on the temperature, with an increasing temperature resulting in an adjustment of the leaf spring effecting a reduction of the passage cross section. This design of the leaf spring additionally achieves a temperature-dependent adjustment of the leaf spring forming the valve. This will achieve an even more precise and more demand-specific distribution of the oil flow between oil cooler and oil cooler bypass channel.

In the following, embodiments of the invention will be explained by means of a drawing. The figures of the drawing show:

DETAILED DESCRIPTION OF THE PREFERRED EMBODIMENTS

Figure 1:
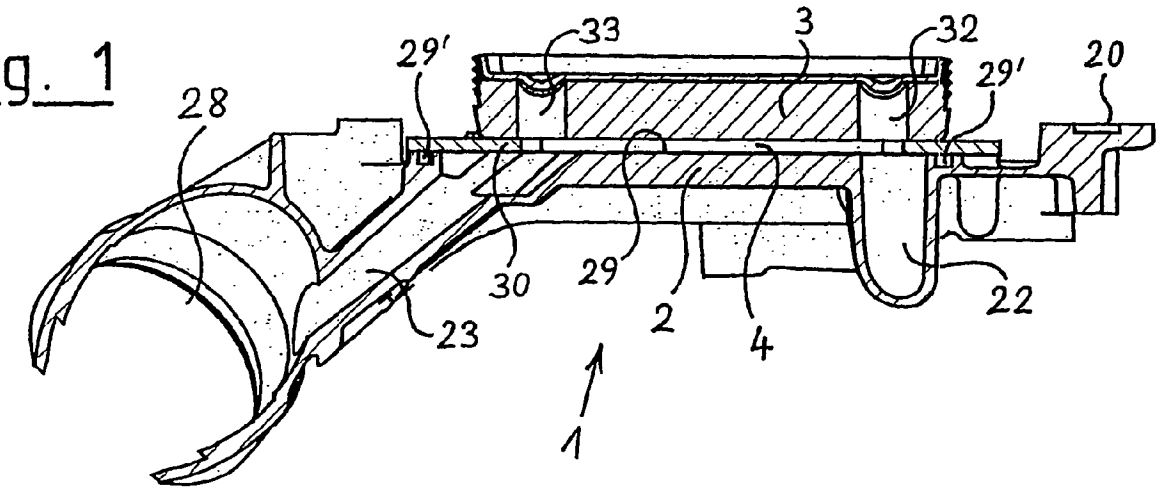
FIG. 1 an oil module in a first embodiment in longitudinal section.
Figure 2:
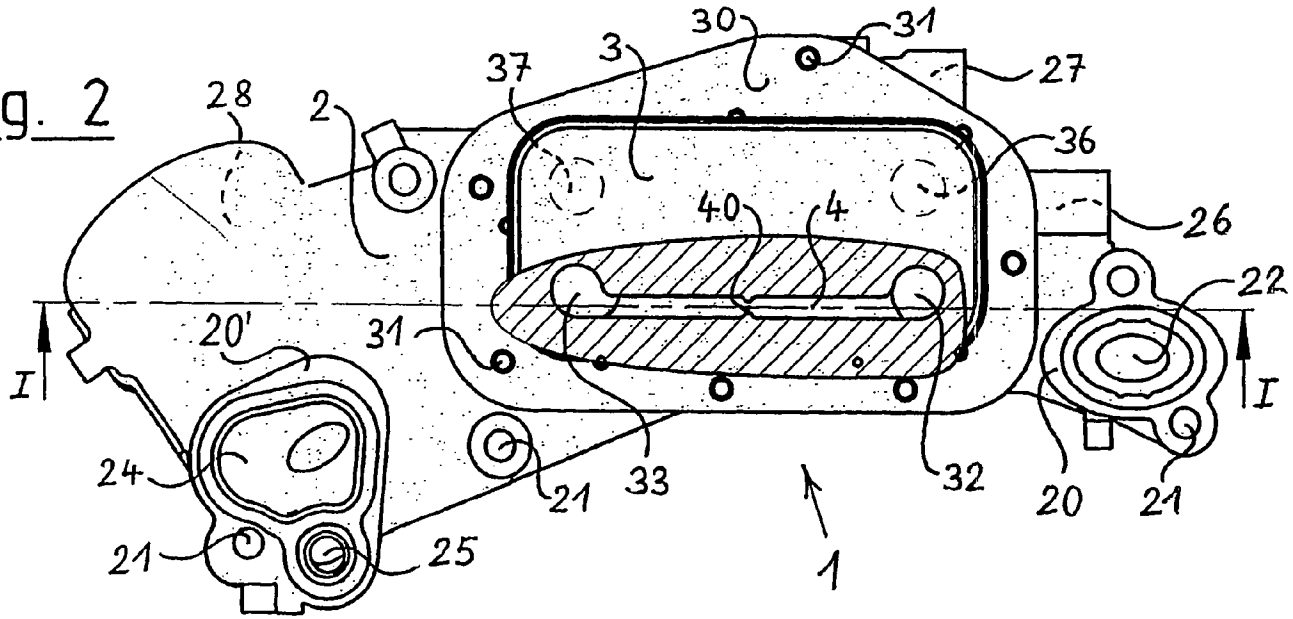
FIG. 2 the oil module of FIG. 1 in a top view, partially cut.

FIG. 1 and FIG. 2 show an oil module 1 in a first embodiment; in FIG. 1 in longitudinal section, and in FIG. 2 in a top view, partly in a cut presentation.

As FIGS. 1 and 2 show, the oil module 1 comprises a carrier element 2 which is a die-casting of light metal, such as aluminum. The carrier element 2 is here connectable by means of two connecting flanges 20, 20' with an internal combustion engine not shown, with an oil feeding channel 22 being connected in flange 20 and an oil discharge channel 24 in flange 20' with the internal combustion engine. Furthermore, an oil transfer channel 23, sectionally visible in FIG. 1, extends through the carrier element 2.

On the side facing towards the top in FIG. 1, and on the side facing the observer in FIG. 2, the carrier element 2 comprises an oil cooler flange 29 on which an oil cooler 3 is flanged in a sealing manner. In a circumferential sealing groove 29', a seal not specially shown is arranged, providing a flange connection which is impervious to fluids.

The oil cooler 3 is of a conventional type. On its side facing the carrier element 2, the oil cooler 3 has a base plate 30. The base plate 30 has several fastening holes 31 which are visible in FIG. 2 in the top view.

One oil inlet 32 and one oil outlet 33 each extend, as additional channels of the oil module 1, through the oil cooler 3 and its base plate 30. The oil inlet 32 is in flow connection with the oil feeding channel 22. The oil outlet 33 of the oil cooler 3 is in flow connection with the oil transfer channel 23.

On the very left in FIGS. 1 and 2, the carrier element 2 has a filter receiver 28 which serves to hold an exchangeable oil filter insert and can be closed in a manner which is impervious to fluids by means of a screwed cap not shown here.

Furthermore, the oil module 1 has an oil cooler bypass channel 4, connecting the oil inlet 32 of the oil cooler 3 with its oil outlet 33 by bypassing the oil cooler 3.

In the first exemplary embodiment of the oil module 1 presented in FIGS. 1 and 2, the oil cooler bypass channel 4 extends over its entire length through the base plate 30 of the oil cooler 3. Here, the bypass channel 4 is formed as a slit extending over the entire thickness of the oil cooler base plate 30 and preferably manufactured together with the remaining base plate 30 in one stamping operation.

As shown in FIG. 2, the oil cooler bypass channel 4 comprises approximately in its middle between oil inlet 32 and oil outlet 33 a cross-sectional narrowing 40 which is formed by two noses in the base plate 30 pointing towards each other. Due to this cross-sectional narrowing 40, a defined flow resistance of the bypass channel 4 will be set. Should a different flow resistance be desired, it can be effected by a corresponding change of the cross-sectional narrowing 40. For this, the oil cooler base plate 30 merely needs to be adjusted in its contour of the bypass channel 4. This can be easily performed by exchanging a tool insert in a stamping tool used for the manufacture of the base plate 30.

Aside from the oil inlet 32 and the oil outlet 33, the oil cooler 3 also comprises one water inlet 36 and water outlet 37 each, ensuring the feeding and discharge of cooling water providing for the heat exchange with the oil in oil cooler 3 for cooling the oil. The cooling water is here fed through a water feeding channel 26 and discharged through a water discharge channel 27 which are partially visible in FIG. 2 each on the right in the background and which are connected in built-in condition to an internal combustion engine with further water lines.

The fastening holes 31 are used for a sealing connection of the oil cooler 3 with the carrier element 2; screws can be passed through said holes into the carrier element 2 and into the threaded holes there provided. The oil module 1 as a whole can then be connected by means of additional screws with the internal combustion engine not shown, said screws being passed through fastening holes 21 which are provided in the carrier element 2.

In the operation of the internal combustion engine, lubricating oil—coming from the oil pump of the internal combustion engine—flows via the connecting flange 20 through the oil feeding channel 22 into the oil module 1. Within the carrier element 2, the oil flows to the oil inlet 32 of the oil cooler 3. The oil flow branches there, with a first partial flow of the oil flowing through the oil cooler 3 and a second partial flow of the oil flowing through the oil cooler bypass channel 4. At the oil outlet 33 of the oil cooler 3, the two partial flows of the oil combine again and jointly flow through the oil transfer channel 23 into the filter receiver 28. With the completed oil module with a filter element inserted into the filter receiver 28 and with the filter cap screwed on, the oil flowing in through the oil transfer channel 23 will flow radially from the outside to the inside through the filter insert and then through the oil discharge channel 24 via the second connecting flange 20' again to the internal combustion engine and in it to the lubricating points to be supplied with oil.

In addition to the oil discharge channel 24, one oil drain channel 25 also extends through the second connecting flange 20'. This oil drain channel 25 serves to drain the filter receiver 28 of oil upon a change of the filter insert. Within the internal combustion engine, the oil drain channel 25 discharges into a pressureless area, for example, into the oil pan.

Both flange connections 20, 20' are sealed by seals not separately provided with reference numbers, which are adjusted in their form to the flanges 20, 20' as well as the channels 22 and, respectively, 24 and 25.

Figure 3:
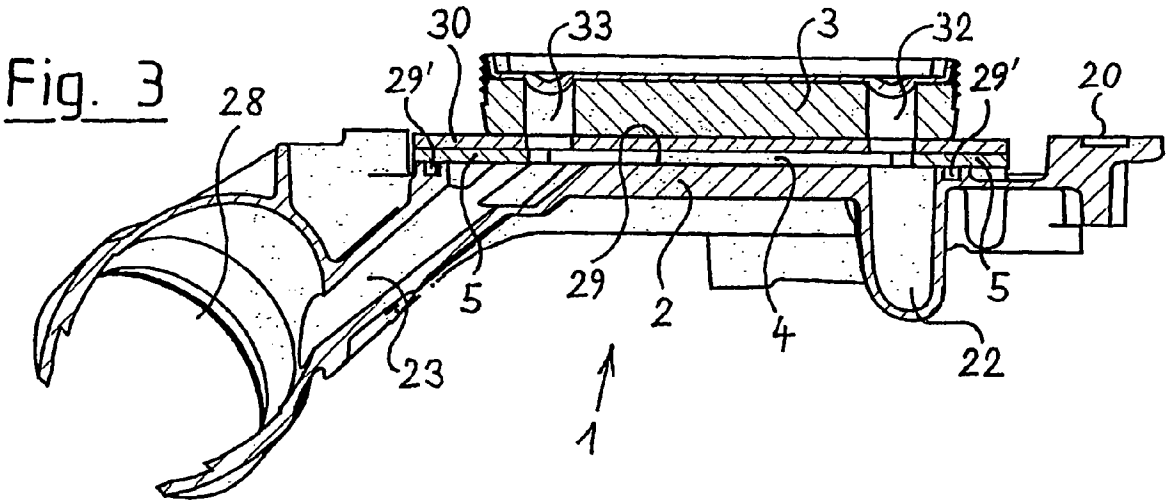
FIG. 3 and FIG. 4, the oil module in a second embodiment in a presentation according to FIGS. 1 and 2.
Figure 4:
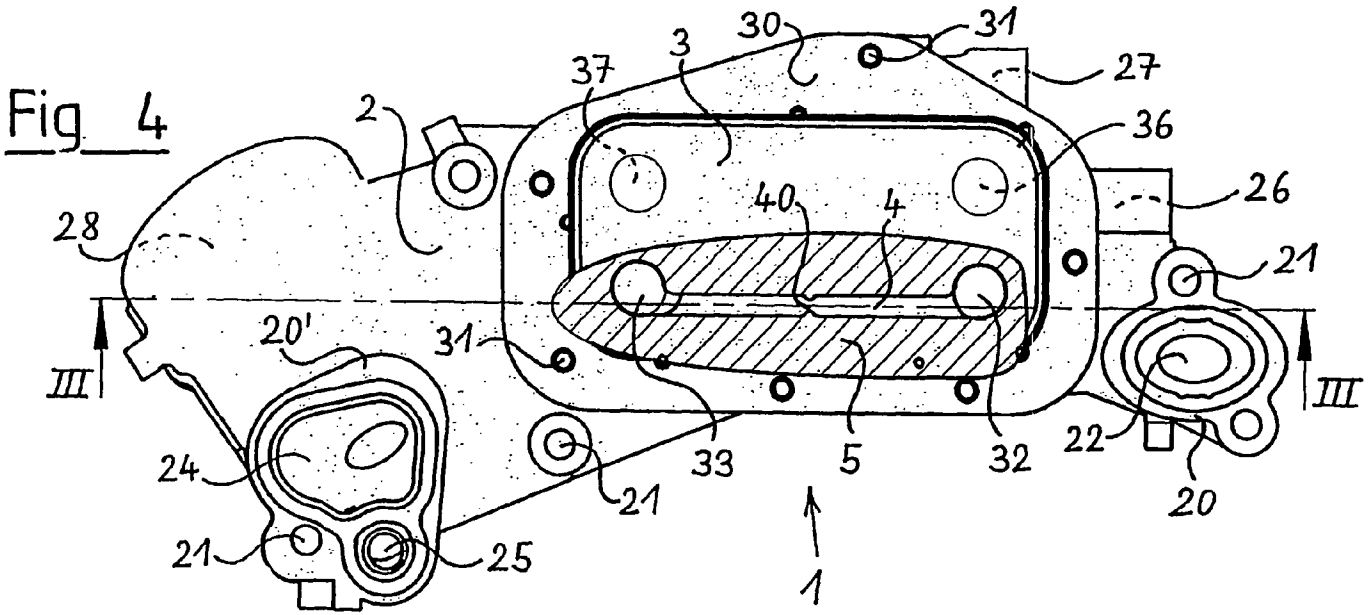

FIGS. 3 and 4 show a second embodiment of the oil module 1. It is characteristic for this embodiment of the oil module 1 that—parallel to the oil cooler base plate 30—an intermediate plate 5 is provided which is arranged between the oil cooler base plate 30 and the oil cooler flange 29 of the carrier element 2 in a sealing manner. The oil cooler 3 is here a conventional type, with the oil cooler base plate 30 also being a conventional type in which the base plate 30 merely has openings for forming the oil inlet 32, oil outlet 33, water inlet 36 and water outlet 37.

In the example according to FIGS. 3 and 4, the intermediate plate 5 has a contour which is equivalent to the contour of the oil cooler base plate 30. Furthermore, the intermediate plate 5 has openings congruent with the openings in the oil cooler base plate 30 which each form a section of oil inlet 32, oil outlet 33, water inlet 36 and water outlet 37.

In the example according to FIG. 3 and FIG. 4, the oil cooler bypass channel 4 is provided completely within the intermediate plate 5. For this, the intermediate plate 5 is provided with a preferably stamped slit extending over its entire thickness, said slit connecting with each other the openings forming the oil inlet 32 and the oil outlet 33. In the course of the oil cooler bypass channel 4, a cross-sectional narrowing 40 is here also provided which specifies a defined flow resistance of the bypass channel 4. Should a different flow resistance of the oil cooler bypass channel 4 be required, a simple and inexpensive change of the intermediate plate 5 will be sufficient. The oil cooler 3 and the carrier element 2 of the oil module 1 need not be changed then.

In its other parts and in its function, the oil module 1 according to the FIGS. 3 and 4 is equivalent to the oil module 1 according to the above described FIGS. 1 and 2.

Figure 5:
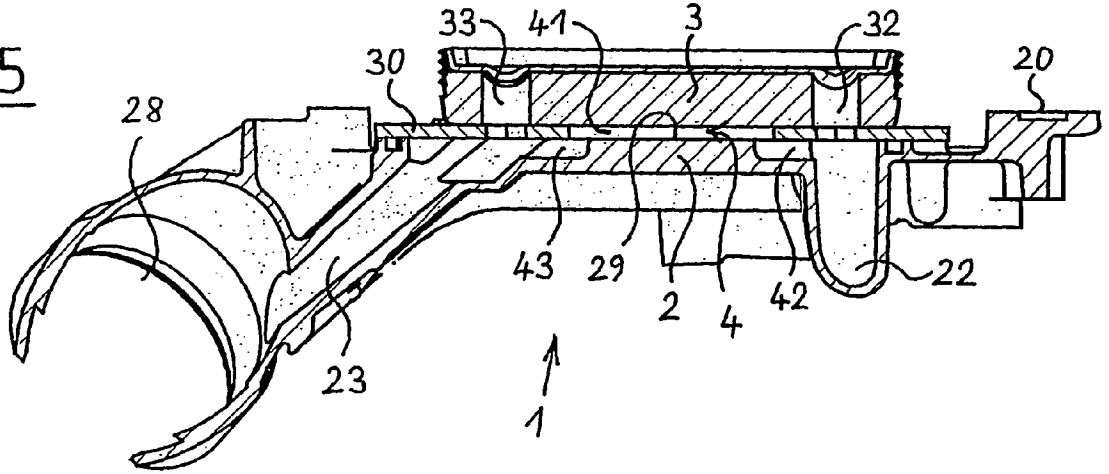
FIG. 5 and FIG. 6, the oil module in a third embodiment, again in the same presentation as in FIGS. 1 and 2.
Figure 6:
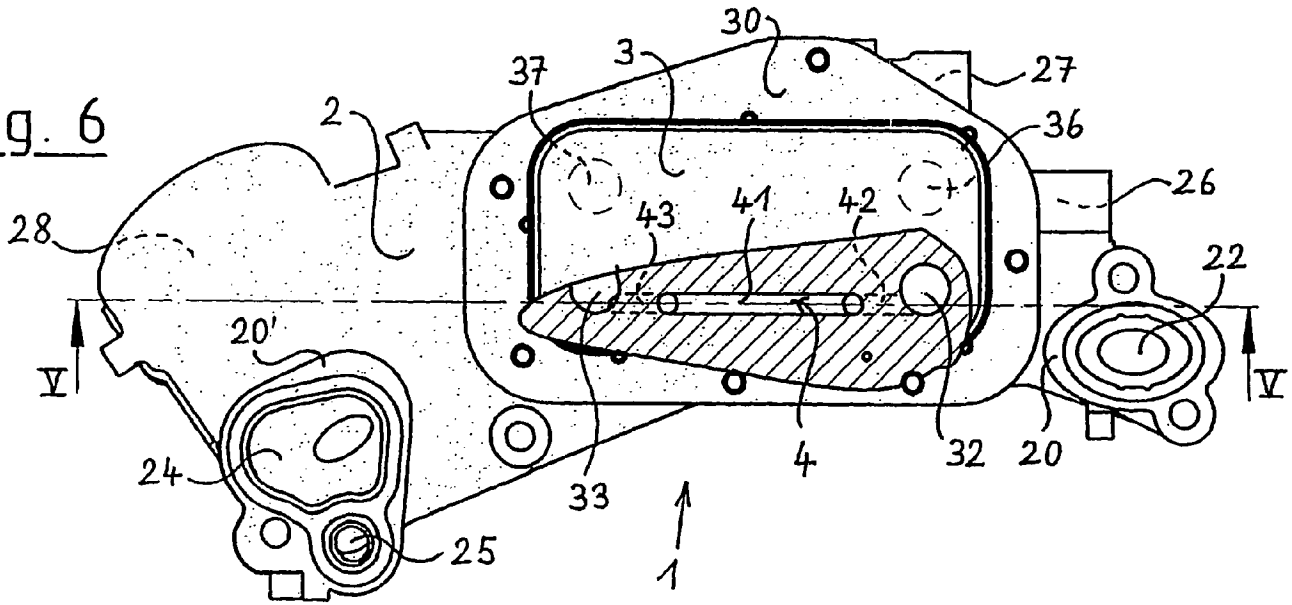

FIGS. 5 and 6 show the oil module 1 in a third embodiment. It is characteristic for this embodiment of the oil module 1 that the oil cooler bypass channel 4 is subdivided into several channel sections. As FIGS. 5 and 6 illustrate, a longer middle section 41 of the oil cooler bypass channel 4 extends through the oil cooler base plate 30. This middle section 41 is connected with two end sections 42, 43 of the bypass channel 4 which are each significantly shorter in relation to the middle section 41 and which are each formed in the carrier element 2. Thus will be achieved that the oil cooler base plate 30—in the area between its openings for the oil inlet 32 and the oil outlet 33 on the one hand and the middle section 41 of the bypass channel 4 on the other hand—comprises one material bridge each which stabilizes the oil cooler base plate 30 and makes it more dimensionally stable. Thus, the risk of distortion of the oil cooler base plate 30 will be especially reliably avoided.

A desired flow resistance of the oil cooler bypass channel 4 can here be specified preferably by the dimensions of the middle section 41, particularly its width, and it can be specifically changed as needed by changing the width of the middle section 41.

In its other parts and in its function, the oil module 1 is equivalent to the above explained exemplary embodiments according to the FIGS. 1 to 4.

Figure 7:
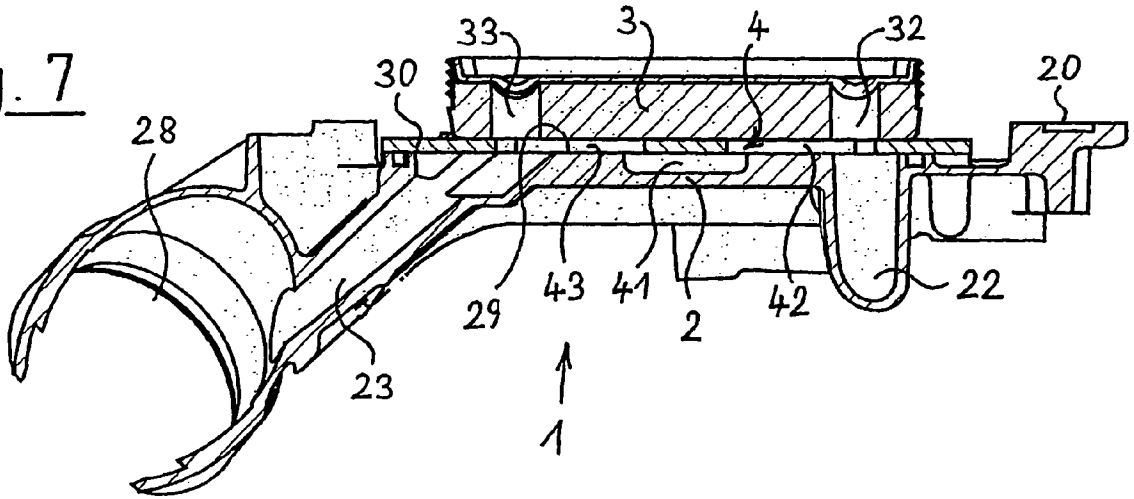
FIG. 7 and FIG. 8, the oil module in a fourth embodiment, again in the same presentation as in FIGS. 1 and 2.
Figure 8:
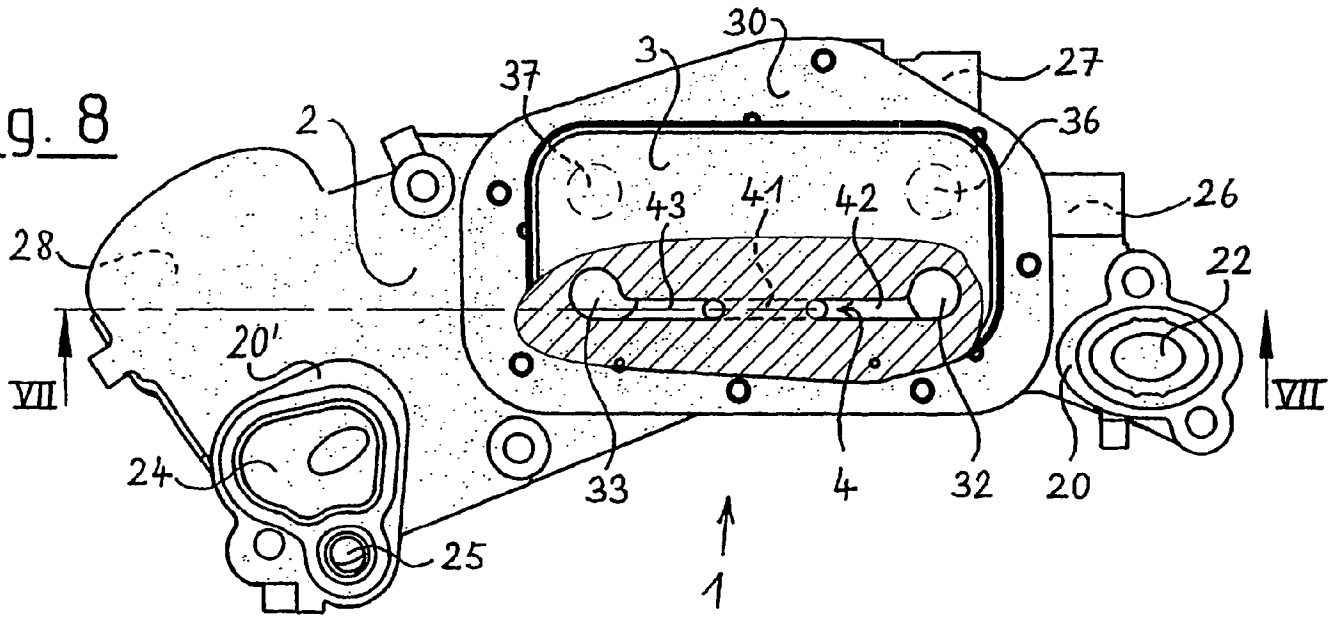

FIGS. 7 and 8 show an oil module 1 in a modified embodiment as compared to FIGS. 5 and 6. In the example according to FIGS. 7 and 8, the oil cooler bypass channel 4 also extends for the most part through the oil cooler base plate 30 and for a smaller part through the carrier element 2. Here, the distribution is selected such that two overall longer end sections 42, 43 extend through the base plate 30 of the oil cooler 3 and a comparatively shorter middle section 41 of the bypass channel 4 extends through the carrier element 2.

With this embodiment of the oil module 1, a desired flow resistance of the oil cooler bypass channel 4 can be preferably specified by adjusting a specific cross section of the end section 42, 43 or one of these two end sections 42, 43.

In its other parts and in its function, the oil module 1 is equivalent to the above explained exemplary embodiments.

Figure 9:
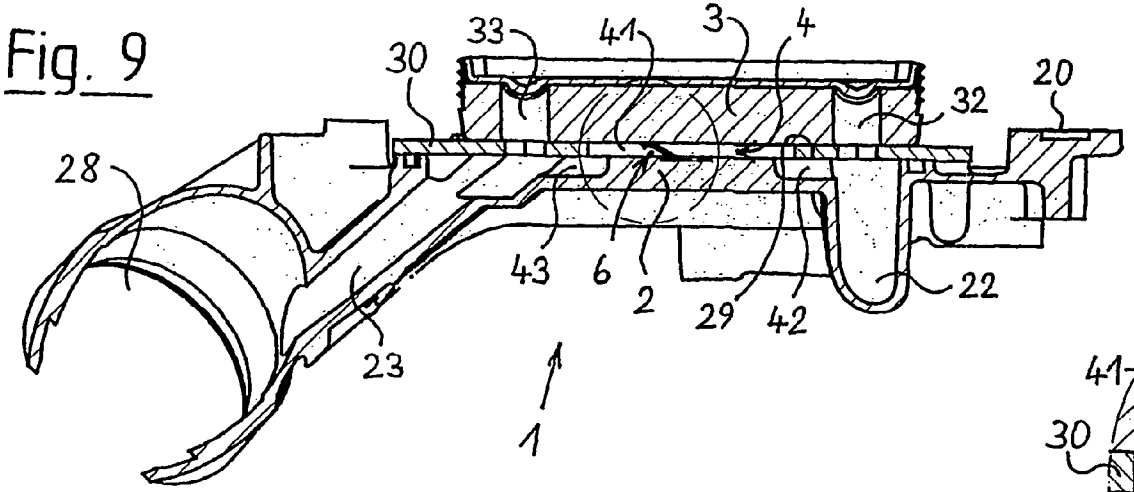
FIG. 9 and FIG. 10, the oil module in a fifth embodiment, again in the same presentation as in FIGS. 1 and 2.
Figure 10:
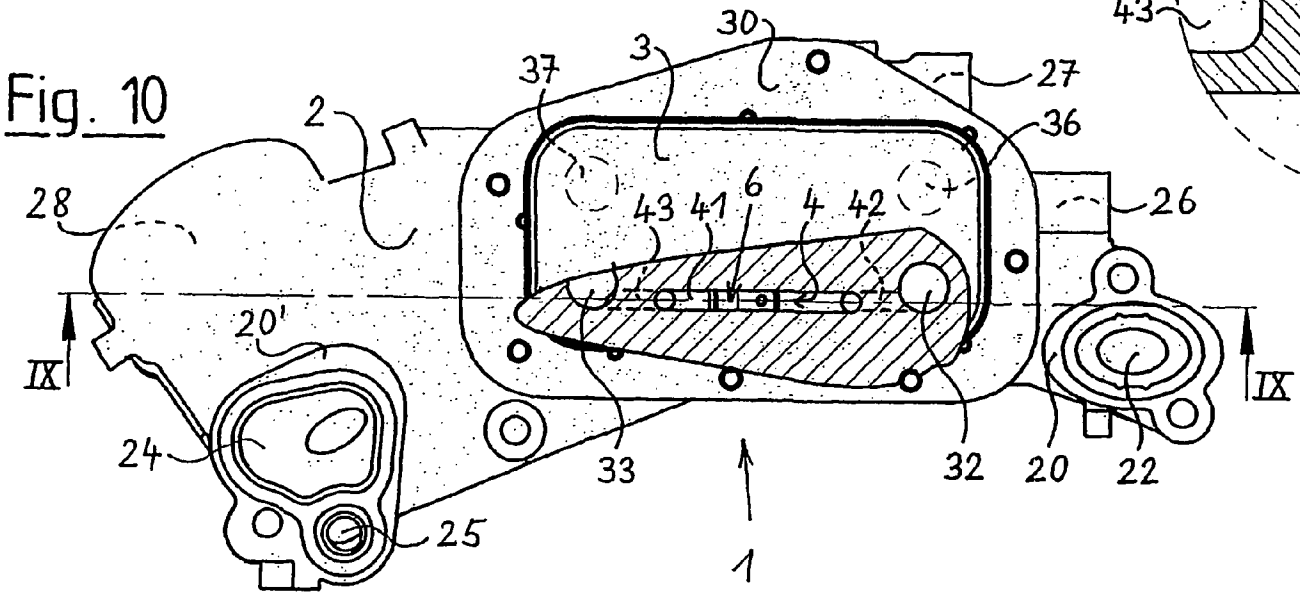

FIGS. 9 and 10 show a fifth exemplary embodiment of the oil module 1 which, in its basic embodiment, is equivalent to the oil module according to FIGS. 5 and 6 but comprises an additional component. This additional component is a valve 6 arranged in the oil cooler bypass channel 4. With the example shown in FIGS. 9 and 10, valve 6 is designed as a leaf valve with a leaf spring 60, said valve being arranged—pointing in the direction of flow of the oil—in the middle section 41 of the oil cooler bypass channel 4 extending within the oil cooler base plate 30.

This valve 6 is used to divide the oil flow flowing through the oil feeding channel 22 in a suitable manner to the oil cooler 3 and the oil cooler bypass channel 4. The leaf spring 60 forming valve 6 is here designed such that—with a high differential pressure between the oil feeding channel 22 and the oil transfer channel 23, such as it is the case especially with low oil temperatures and high oil viscosity—due to the resulting pressure difference on both sides of valve 6, said leaf spring is brought into a stretched position in which valve 6 releases a greater cross section of the oil cooler bypass channel 4. With a smaller pressure difference, valve 6 reduces due to the reset force of leaf spring 60—the cross section of the oil cooler bypass channel 4, as presented in FIGS. 9 and 10 so that a greater portion of the oil flow is then passed through the oil cooler 3 and will be cooled.

In its other elements and in its other function, the oil module 1 according to FIGS. 9 and 10 is equivalent to the above described examples.

Figure 11:
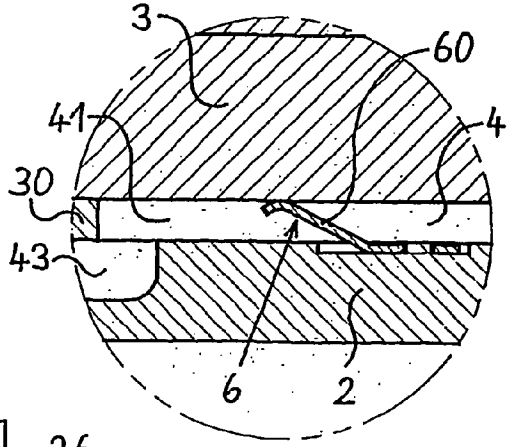
FIG. 11 the circled detail in FIG. 9 in an enlarged sectional presentation.

FIG. 11 finally shows the detail, circled in FIG. 9, from the oil module 1 in an enlarged presentation. In the center of FIG. 11, the valve 6 is visible in the form of the leaf spring 60. On the right end in FIG. 11, the leaf spring 60 is connected with the carrier element 2, for example pressed or riveted or welded.

FIG. 11 here shows a condition of the valve 6 as it occurs with a low pressure difference on the two sides of valve 6. In case of a low or an entirely lacking pressure difference, valve 6 assumes a closed or approximately closed position, with the entire or at least the largest part of the oil flow being guided through the oil cooler 3. In case of a higher pressure difference, the free end of the leaf spring 60, pointing towards the left in FIG. 11, will move downwardly within the middle section 41 of the oil cooler bypass channel 4, with an increasingly larger passage cross section being released and an increasingly larger part of the oil flow being able to flow through the oil cooler bypass channel 4.

Aside from its property as a leaf spring, valve 6 can additionally either consist of a bimetal strip or comprise a bimetal strip in its course. Such a bimetal strip can additionally achieve that the valve 6 will be additionally automatically adjusted depending on the temperature of the oil. Here the valve 6 with bimetal spring is designed such that, at a low temperature, valve 6 releases a larger cross section and, at a higher temperature, it releases a smaller cross section of the oil cooler bypass channel 4.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. An oil module for an internal combustion engine, comprising:

a carrier element that can be attached to an engine block of the internal combustion engine via a flange and carries at least one oil filter and an oil cooler;

the oil module being provided with at least two channels for guiding oil and at least one channel for guiding water, one of the two channels for guiding oil being an oil cooler bypass channel connecting an oil inlet of the oil cooler to an oil outlet of the oil cooler, wherein in operation a first partial flow of the oil flows through the oil cooler and a second partial flow of the oil flows through the oil cooler bypass channel bypassing the oil cooler, such that the partial flow of the oil flowing through the oil cooler bypass channel is caused to avoid flowing through the oil cooler, an oil cooler base plate forming one part of the oil cooler and occluding the oil cooler on the carrier side, the oil cooler base plate lying in a plane and having one side facing the oil cooler and an opposite side facing the carrier element, wherein at least a main part of the oil cooler bypass channel extends through the oil cooler base plate in the plane of the oil cooler base plate and is sealed towards at least one of an outside environment on the oil cooler side by the remaining oil cooler and on the carrier element side by the carrier element.

2. An oil module according to claim 1, wherein the oil cooler bypass channel is formed in the oil cooler base plate by at least one slit extending over an entire thickness of the oil cooler base plate from the oil cooler side to the carrier element side.

3. An oil module according to claim 1, wherein the oil cooler bypass channel in the oil cooler base plate is formed by at least one depression formed in the oil cooler base plate on one of the carrier element side and the oil cooler side.

4. An oil module according to claim 1, wherein the oil cooler bypass channel extends over its entire length in the oil cooler base plate.

5. An oil module according to claim 1, wherein one part of the oil cooler bypass channel lying in the oil cooler base plate forms a middle section of the oil cooler bypass channel and two shorter end sections of the oil cooler bypass channel each extend through the carrier element.

6. An oil module according to claim 1, wherein one part of the oil cooler bypass channel lying in the oil cooler base plate forms two end sections of the oil cooler bypass channel and a shorter middle section of the oil cooler bypass channel extends through the carrier element.

7. An oil module according to claim 1, wherein the oil cooler bypass channel has a cross section comprising a throttle effect.

8. An oil module according to claim 1, wherein the oil cooler bypass channel has, in its course, at least one cross-sectional narrowing providing a throttling effect.

9. An oil module according to claim 8, wherein the cross-sectional narrowing is formed by at least one nose protruding into the oil cooler bypass channel.

10. An oil module according to claim 8, wherein the cross-sectional narrowing is formed by at least one overlapping area between one end of the oil cooler bypass channel and a channel area on the carrier element side being connected with one of the oil inlet and oil outlet of the oil cooler.

11. An oil module according to claim 1, wherein the oil cooler base plate is a stamping of metal.

12. An oil module according to claim 11, wherein the oil cooler base plate is fabricated from aluminum.

13. An oil module according to claim 11, wherein the oil cooler base plate is manufactured by means of a stamping tool with an exchangeable tool insert in an area of the oil cooler bypass channel.

14. An oil module according to claim 1, wherein a valve is arranged in the course of the oil cooler bypass channel which, depending on a pressure difference between the oil inlet and the oil outlet of the oil cooler, produces a modifiable passage cross section, with the passage cross section being smaller at a lower differential pressure and the passage cross section being larger at a higher differential pressure.

15. An oil module according to claim 14, wherein the valve is formed by a leaf spring which is arranged in the oil cooler bypass channel pointing into a direction of flow of the oil, with the leaf spring, in a non-loaded or lightly loaded differential pressure condition, obliquely extending through the oil cooler bypass channel and, in a more strongly loaded differential pressure condition, being automatically adjustable from its obliquely extending position through the oil cooler bypass channel into a position increasingly extending in parallel direction to the oil cooler bypass channel, producing an increasing cross section.

16. An oil module according to claim 14, wherein the leaf spring comprises a bimetal strip, by which the leaf spring in its position in the oil cooler bypass channel is automatically adjustable depending on a temperature of the oil flowing through the bypass channel, with an increasing temperature resulting in an adjustment of the leaf spring effecting a reduction of the passage cross section.

17. An oil module for an internal combustion engine comprising:

at least two channels formed in the oil module for guiding oil and at least one channel formed in the oil module for guiding water, one of the two channels for guiding oil being an oil cooler bypass channel connecting an oil inlet of the oil cooler to an oil outlet of the oil cooler, wherein in operation a first partial flow of the oil flows through the oil cooler bypass channel bypassing the oil cooler, such that the first partial flow of the oil flowing through the oil cooler bypass channel is caused to avoid flowing through the oil cooler, a carrier element having a flange for attaching to an engine block of the internal combustion engine and being configured to carry at least one oil filter and an oil cooler, and an oil cooler base plate forming a part of the oil cooler and occluding the oil cooler on the carrier side, the oil cooler base plate lying in a plane and having one side facing the oil cooler and an opposite side facing the carrier element, with at least a main part of the oil cooler bypass channel extending through the oil cooler base plate in the plane of the oil cooler base plate, the main part of the oil cooler bypass channel being sealed towards at least one of an outside environment on the oil cooler side by the remaining oil cooler and an outside environment on the carrier element side by the carrier element.

18. An oil module for an internal combustion engine, comprising:

a carrier element having a flange for attaching to an engine block of the internal combustion engine and carrying at least an oil filter and an oil cooler;

the oil module being provided with at least one channel extending through the carrier element for guiding oil and with at least one channel extending through the carrier element for guiding water, and with an oil cooler bypass channel connecting an oil inlet of the oil cooler to an oil outlet of the oil cooler, wherein in operation a first partial flow of the oil flows through the oil cooler and a second partial flow of the oil flows through the oil cooler bypass channel bypassing the oil cooler, such that the partial flow of the oil flowing through the oil cooler bypass channel is caused to avoid flowing through the oil cooler, an oil cooler base plate forming one part of the oil cooler and occluding the oil cooler on the carrier side, the oil cooler base plate lying in a plane and having one side facing the oil cooler and an opposite side facing the carrier element, at least a main part of the oil cooler bypass channel extending through the oil cooler base plate in the plane of the oil cooler base plate and being sealed from an outside environment on at least one of the oil cooler side by the remaining oil cooler and on the carrier element side by the carrier element.

* * * * *